United States Patent [19]

Dantlgraber

[11] 4,277,228

[45] Jul. 7, 1981

[54] RADIAL PISTON PUMP

[75] Inventor: Jörg Dantlgraber, Lohr/Main, Fed. Rep. of Germany

[73] Assignee: G. L. Rexroth GmbH, Lohr/Main, Fed. Rep. of Germany

[21] Appl. No.: 796,879

[22] Filed: May 16, 1977

[30] Foreign Application Priority Data

May 18, 1976 [DE] Fed. Rep. of Germany ..... 2622010

[51] Int. Cl.[3] ..... F04B 1/04

[52] U.S. Cl. ..... 417/273; 417/456; 417/464

[58] Field of Search ..... 417/273, 457, 459, 467, 417/469, 456, 464–466; 137/539

[56] References Cited

U.S. PATENT DOCUMENTS

| | | | |
|---|---|---|---|
| 661,603 | 11/1900 | Gold | 137/539 |
| 956,050 | 4/1910 | Dickinson | 137/539 |
| 1,944,124 | 1/1934 | Goodman | 137/539 X |
| 2,679,808 | 6/1954 | Thun | 417/273 |
| 3,092,037 | 6/1963 | Rhodes | 417/273 |
| 3,320,902 | 5/1967 | Pashke | 417/460 X |
| 3,682,572 | 8/1972 | Yarger | 417/273 |
| 3,744,380 | 7/1973 | Steiger | 417/273 X |
| 3,912,421 | 10/1975 | Gelin | 417/464 X |
| 3,945,766 | 3/1976 | Gelin | 417/465 X |

FOREIGN PATENT DOCUMENTS

| | | | |
|---|---|---|---|
| 1294813 | 5/1969 | Fed. Rep. of Germany | 417/273 |
| 954830 | 1/1950 | France | 417/273 |
| 1134962 | 4/1957 | France | 417/273 |
| 1487395 | 5/1967 | France | 417/273 |
| 2307985 | 11/1976 | France | 417/273 |
| 189070 | 4/1964 | Sweden | 417/459 |

*Primary Examiner*—Carlton R. Croyle
*Assistant Examiner*—Edward Look
*Attorney, Agent, or Firm*—Michael J. Striker

[57] ABSTRACT

A radial piston pump comprises a housing bounding a suction chamber therein and at least one valve piston unit mounted in the housing. The valve piston unit includes a pressure valve defining a pressure chamber, a movable piston having an axial passage operatively communicating the suction chamber with the pressure chamber, and a suction valve located in the axial passage of the piston. The suction valve is operative for opening and closing the axial passage of the piston so as to establish and interrupt the above communication, respectively. The piston performs a suction stroke and a working stroke, and a valve member of the suction valve is open during the suction stroke of the piston. The valve member has such a mass that it is opened by an accelerative force produced during the above suction stroke of the piston. The piston is moved by an eccentric mounted on a rotatable shaft, which eccentric has a circumferential groove operatively communicating the suction chamber with the axial passage of the piston.

9 Claims, 3 Drawing Figures

RADIAL PISTON PUMP

BACKGROUND OF THE INVENTION

The present invention relates to a radial piston pump. More particularly, it relates to a radial piston pump having a pressure valve and a suction valve.

Radial piston pumps have been proposed having pressure valves and suction valves. In a known pump of this type a pressure valve and a piston valve each form an independent control unit located in a separate housing. In this case, in order to provide for a high degree of filling and for sufficient suction characteristics, an easy opening of the suction valve must be assured. It has been attempted to solve the above problem by using a weak valve spring and a comparatively large flow-through cross-section of an opening of the suction valve. However, even so the degree of filling is still low and the suction characteristics are still not sufficient.

SUMMARY OF THE INVENTION

Accordingly, it is an object of the present invention to provide a radial piston pump which avoids the disadvantages of the prior art radial piston pumps.

More particularly, it is an object of the present invention to provide a radial piston pump which has a higher degree of filling and better suction characteristics than the conventional radial piston pumps.

Another object of the present invention is to provide a radial piston pump which has a maximum degree of filling and suction characteristics.

In keeping with these objects, and with others which will become apparent hereinafter, one feature of the present invention provides for a radial piston pump having a housing which is provided with a suction chamber therein, and at least one valve piston unit mounted in the housing, which piston unit has a pressure valve means defining a pressure chamber, a movable piston having an axial passage which communicates the suction chamber with the pressure chamber, and a suction valve means located in the axial passage of the piston and operative for closing and opening the axial passage of the piston. The piston performs a suction stroke and a working or pressure stroke, and a valve member of the suction valve is open during the suction stroke of the piston. The valve member of the suction valve has such a mass that during the suction stroke of the piston the force of a spring urging the valve member into a closed position is overcome by the action of the accelerating force and the suction valve is opened. Thus, the valve member of the suction valve is opened not by negative pressure produced in a valve chamber but by the above mentioned accelerating force produced during the suction stroke of the piston. In the above construction the degree of filling and the suction characteristics are superior, as compared with those of the conventional radial piston pumps.

The piston has a head portion whereas the axial passage has a portion extending through the head portion of the piston. The suction valve means are located in the head portion of the piston, and particularly in the above portion of the axial passage thereof.

Another feature of the present invention is that the pump comprises an eccentric mounted on a rotatable shaft for joint rotation therewith, which eccentric has a contact surface movably cooperating with the piston so as to move the latter, and a groove formed in this contact surface. The above groove operately communicates the suction chamber with the axial passage of the piston. The piston has a sliding flange which forms the above contact surface, and the axial passage may extend through the sliding flange. In this case the groove is actually in operative communication with that portion of the axial passage which is formed in the above sliding flange.

Still another feature of the present invention is that the axial passage has an upper enlarged portion in which the suction valve means are located. A wall which bounds the remainder of the axial passage of a smaller cross-section has a sleeve-shaped projection. This projection extends into the enlarged portion of the axial passage and forms a seat for the suction valve member. The latter operatively cooperates with the above projection forming the seat, so as to open and close the axial passage of the piston.

An additional feature of the present invention is that the outer surface of the eccentric has lower and upper reversal points and the eccentric rotates in a predetermined direction so that the piston performs its suction stroke while moving in contact with the outer surface of the eccentric between the above lower and upper reversal points. The groove is so dimensioned that it extends over half of the length of the outer surface of the eccentric in the circumferential direction thereof and between the above reversal points. The thus dimensioned groove assures that the suction chamber of the housing communicates with the axial passage of the piston during the suction stroke of the latter.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
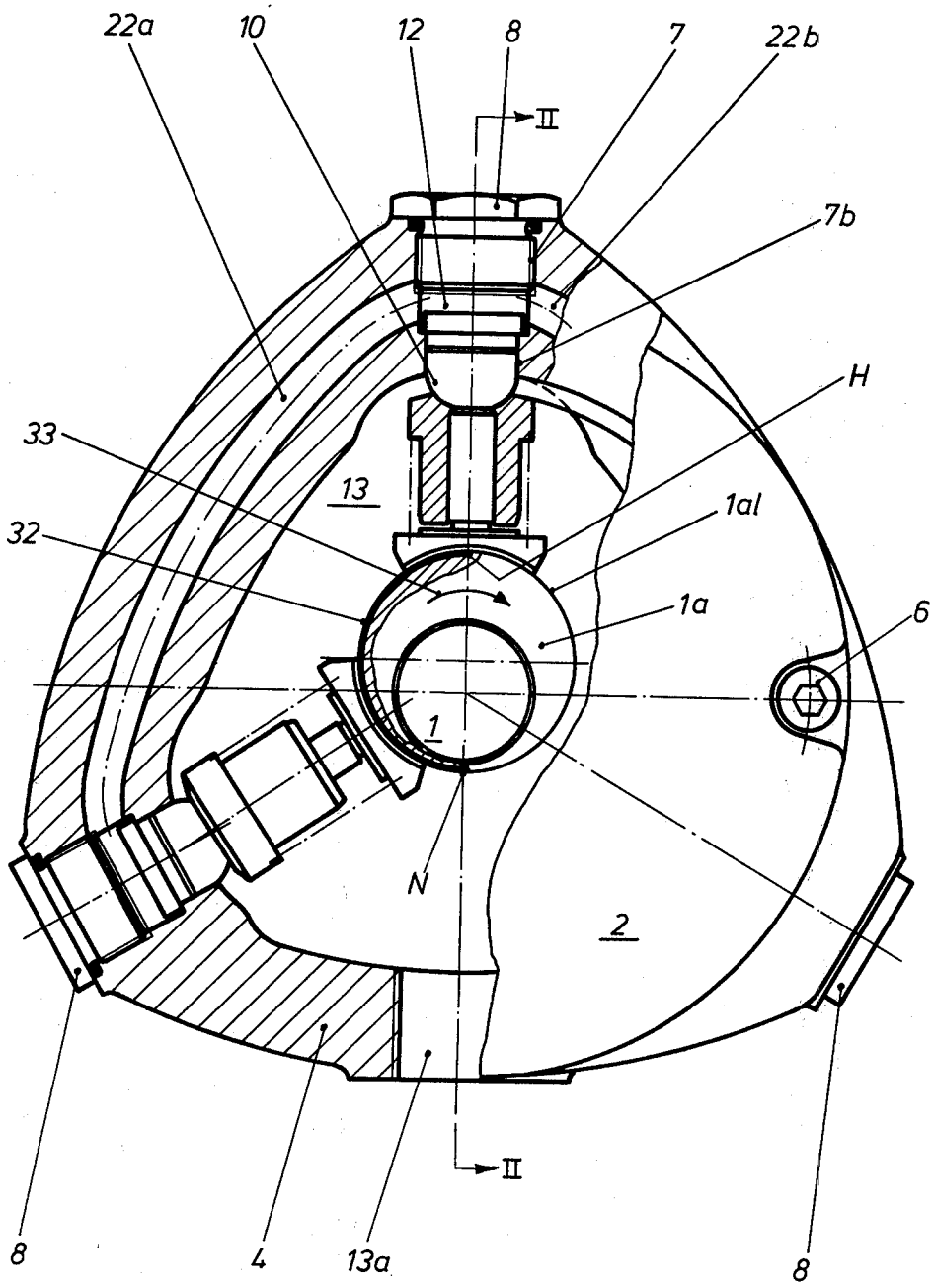
FIG. 1 is a sectional view of a radial piston pump in accordance with the present invention, taken in a direction transverse to the axis of the pump shaft.
Figure 2:
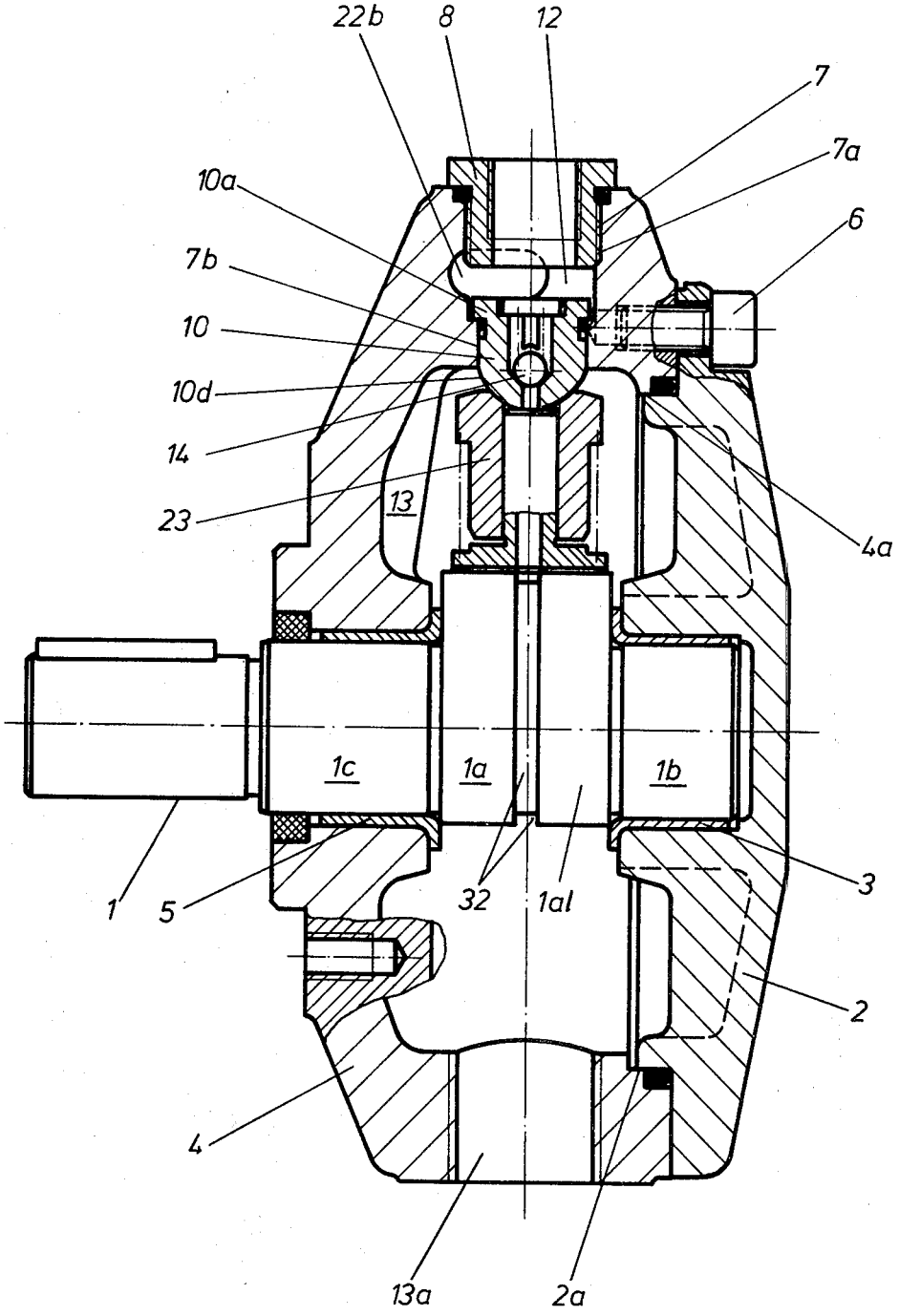
FIG. 2 is a sectional view of the radial piston pump, taken on line II—II of FIG. 1.
Figure 3:
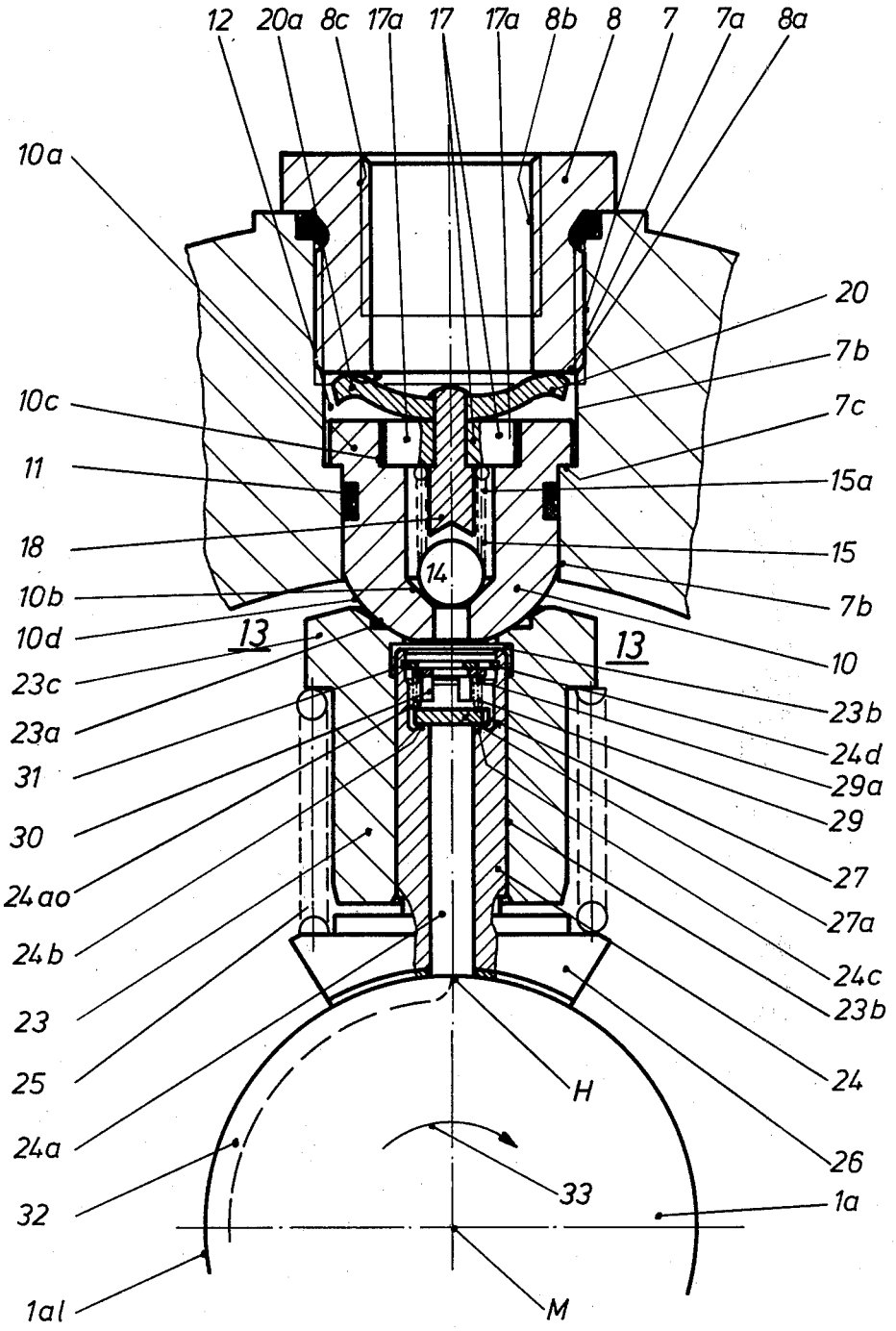
FIG. 3 is an enlarged sectional view of the radial piston pump, taken on line III—III of FIG. 1 and particularly showing a valve piston unit of the pump.

FIG. 1 shows a rotary piston pump in accordance with the present invention wherein a pump shaft is identified by reference numeral 1 and has an eccentric identified by reference numeral 1*a*. One end portion 1*b* of the pump shaft 1 is received in a bushing 3 which is mounted in a cover 2 of a housing 4 of the pump. An opposite end portion 1*c* of the pump shaft 1 is received in a bushing 5 which is mounted directly in the housing 4 of the pump. The cover 2 of the housing 4 has a bearing surface 2*a* which is received in a recess 4*a* of the housing 4. The cover 2 is mounted on the housing 4 by screws 6.

Three radial bores 7 are provided in the housing 4 and uniformly distributed over a circumferential surface thereof. An outer portion 7*a* of each bore 7 has an inner thread for screwing a locking screw 8 therein. An inner portion 7*b* of the bore 7 has a diameter smaller than the diameter of the outer portion 7*a* thereof and forms a bearing surface for a body 10 of a pressure valve. The pressure valve body 10 has a flange 10*a* which abuts against a surface 7*c* and thereby secures the pressure valve body 10 against an axial displacement. A sealing ring 11 assures sealing of a pressure chamber 12 from an inner chamber 13 of the housing 4. The inner chamber 13 forms a suction chamber of the pump. The housing 4 of the pump has a throughgoing suction bore 13*a* communicating with the inner chamber 13.

A valve member of the pressure valve body 10 is formed by a ball 14 which is urged by a weak spring 15 towards a valve seat 10*b*. An end portion 15*a* of the spring 15 which is opposite to the ball 14 abuts against a plate 17 provided with a through bore 17*a*. The plate 17 is received in a hole 10*c* of the pressure valve body 10. A screw 18 limiting an axial movement of the ball 14 is mounted in a plate 17. A resilient member 20 is located at the opposite side of the plate 17 and connected thereto. An outer surface 20*a* of the resilient member 20 abuts against a face surface 8*a* of the locking screw 8 whereby the pressure valve body 10 is secured against displacement in the axial direction. The pressure chamber 12 which is formed between the pressure valve body 10 and the locking screw 8 communicate channels 22*a*, 22*b* provided in the housing 4 with each other. The locking screw 8 has a through bore 8*b* having an inner thread 8*c* which serves for connecting a not-shown pressure conduit to the locking screw 8.

An end portion 10*d* of the pressure valve body 10 which faces towards the inner chamber 13 of the housing 4 is ball-shaped. A sealing surface 23*a* of a cylindrical member 23 sealingly abuts against the ball-shaped end portion 10*d* of the pressure valve body 10. A lower edge portion of the sealing surface 23*a* has a diameter which is smaller than the diameter of a portion of a cylinder bore 23*b* in which a piston 24 is received. This assures that during the working stroke of the piston 24 the sealing surface 23*a* of the cylindrical member 23 will sealingly abut against the ball-shaped portion 10*d* of the pressure valve body 10. The sealing surface 23*a* of the cylindrical member 23 is additionally pressed against the ball-shaped portion 10*a* of the pressure valve body 10 by a spring 25 so that during the suction stroke of the piston 24 the sealing surface 23*a* of the cylindrical body 23 sealingly abuts against the ball-shaped surface 10*d* of the pressure valve body 10. One end portion of the spring 25 abuts against a sliding flange 26 which is one piece with the piston 24. An opposite end portion of the spring 25 abuts against a radially outwardly projecting flange 23*c* of the cylindrical member 23.

The piston 24 has an axial passage 24*a*. An upper portion 24*ao* of this passage has a diameter which is larger than the diameter of the remainder of the axial passage 24*a*. Elements forming a suction valve 27 are located in the upper enlarged portion 24*ao* of the axial passage 24*a* of the piston 24. A wall which bounds a portion of the passage 24*a* having a diameter smaller than the diameter of the portion 24*ao* has a sleeve-shaped projection 24*c* extending into the enlarged portion 24*ao* of the passage 24. The sleeve-shaped projection 24*c* forms a seat 24*b* for a valve member 27*a* of the suction valve 27. The suction valve member 27*a* is plate-like and urged against the valve seat 24*c* by a weak spring 29. An end portion 29*a* of the spring 29 abuts against a supporting member 30 for the valve member 27*a*. The supporting member 30 abuts, in turn, against a retaining ring 31 which is received in an annular groove provided in an inner wall of the piston 24. The axial passage 25*a* of the piston 24 passes through the sliding flange 26 and is in operative communication with a groove 32 which is formed in a contact surface 1*al* of the eccentric 1*a*. The groove 32 extends from the highest reversal point H to the lowest reversal point N of the eccentric 1*a*. The valve member 27*a* of the suction valve has a mass which is so great that during rotation of the pump at a predetermined speed a force of the spring 29 will be overcome by an accelerating force acting upon it.

The rotary piston in accordance with the present invention operates as follows:

The eccentric 1*a* as shown in the drawing is located in its upper dead position and supports the piston 24 in an upper position of the latter. In this case, the axial passage 24*a* of the piston 24 is in an operative communication with an initial portion of the groove 32, which portion is adjacent to the highest reversal point H of the eccentric 1*a*. When the shaft 1 rotates in the direction of the arrow 33 (FIG. 1) the piston will move in a direction towards its lower dead point in correspondence to an angle of rotation of the eccentric 1*a*. The cylindrical member 23 with its sealing surface 23*a* turns around a not-shown center of the pressure valve body 10 and also in a direction of a center M of the eccentric 1*a* which center M rotates around the axis of rotation of the shaft 1. An axis extending through the non-shown center is parallel to the axis of eccentric extending through the center M. The greatest deviation of the cylindrical member 23 will take place when the shaft 1 is turned through 90° from the position shown in the drawing. During movement of the piston 24 from the upper to the lower dead point acceleration is produced so that the piston 24 has its maximum speed when it approaches its lower dead point. Since the acceleration is directed in the direction towards the center M of the eccentric 1*a*, a force is produced which is applied to the valve member 27*a* of the suction valve 27. This force acts opposite to the direction of the piston 24 and overcomes the force of the spring 29 so that the valve member 27 is lifted from the valve seat 24*b*. As a result, the working fluid unimpededly passes through the groove 32 of the eccentric 1*a* and the axial passage 24*a* of the piston 24 into the cylindrical chamber 23*b*. Therefore, in accordance with the invention, the valve member 27*a* of the suction valve 27 is opened not by a negative pressure in the cylindrical chamber 23*b* as in the prior art pumps, but by the above force produced by the speed of the piston 24 during its suction stroke, which force acts upon the valve member 27*a*.

The groove 32 terminates at the lower reversal point N of the eccentric 1*a*. Thus, when the piston 24 approaches the lower dead point, the operative communication of the axial passage 24*a* of the piston 24 with the groove 32 of the eccentric 1*a* is interrupted. Now the entire contact surface 1*al* of the accentric 1*a* is available for transmission of the operative force to the piston 24 through the sliding flange 26 so as to perform a working or pressure stroke.

Two other valve piston units each comprising the piston 24 with the sliding flange 26 and the suction valve 27 operate in a manner identical to that of the above described unit.

It will be understood that each of the elements described above, or two or more together, may also find a useful application in other types of constructions differing from the types described above.

While the invention has been illustrated and described as embodied in a rotary piston pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A radial piston pump, comprising a housing bounding a suction chamber therein; at least one valve piston unit mounted in said housing, said unit including pressure valve means defining together with said housing a pressure chamber, a movable piston provided with a radial inner passage which operatively communicates said suction chamber with said pressure chamber, said piston having a head section located adjacent to said pressure valve means and bounding a first radial portion of said passage and a bottom section spaced from said head section and bounding a second radial portion of said passage, and suction valve means located in said first radial portion of said passage which is bounded by said head section of said piston and operative for opening and closing said passage so as to respectively establish and interrupt said communication between said suction chamber and said pressure chamber; and a rotatable eccentric in said housing having an axis of rotation and a contact surface which is in surface contact with said bottom section of said piston so as to displace the latter relative to said axis of said eccentric and to tilt said piston around a further axis which is spaced from said axis of said eccentric, said contact surface of said eccentric being provided with a circumferential groove operatively communicating said second radial portion of said radial passage of said piston with said suction chamber so that a working fluid flows from said circumferential groove of said eccentric radially directed into said radial inner passage of said piston, first into said second radial section of said radial passage which is bounded by said bottom portion of said piston, and then into said first radial section of said radial passage which is bounded by said head portion of said piston and thereby to said suction valve means, said contact surface of said eccentric having upper and lower reversal points and being rotatable in a predetermined direction so that a suction stroke of said piston is performed when the latter moves in contact with said contact surface of said eccentric between said upper and said lower reversal points thereof, said groove extending in a circumferential direction of said eccentric to a length equal to half of the length of said contact surface in said circumferential direction and between said upper and said lower reversal points so that said passage of said piston communicates with said groove of said eccentric during said suction stroke of the latter.

2. The pump as defined in claim 1, wherein said piston performs a suction stroke and a working stroke, said suction valve means having a valve member which is open during said suction stroke of said piston.

3. The pump as defined in claim 1, wherein said piston is provided with a sliding flange forming a further contact surface contacting said contact surface of said eccentric, said passage extending through said sliding flange so as to operatively communicate with said groove of said eccentric.

4. The pump as defined in claim 1, wherein said first portion of said passage has a diameter larger than the diameter of said second portion thereof, said remainder section of said piston bounding said second portion of said passage having a projection which forms a seat of said suction valve means.

5. The pump as defined in claim 4, wherein said projection is sleeve-shaped.

6. The pump as defined in claim 5, wherein said suction valve means has a valve member operatively cooperating with said projection so as to close and open said passage of said piston.

7. The pump as defined in claim 1, wherein said piston is movable at a predetermined speed so as to perform a suction stroke, said suction valve means which is located in said passage of said piston having a valve member movable between an open and a closed position and means for urging said valve member into said closed position with a predetermined force, said valve member having a mass which is sufficient for overcoming said predetermined force of said urging means during said suction stroke of said piston whereby said valve member is moved into said open position.

8. The pump as defined in claim 7, wherein said urging means is a spring.

9. The pump as defined in claim 1, wherein said pressure valve means includes a pressure valve body having a center forming said further axis around which said piston tilts.

* * * * *